US008458958B2

(12) United States Patent
Cress

(10) Patent No.: US 8,458,958 B2
(45) Date of Patent: Jun. 11, 2013

(54) DEVICE FOR INSERTION BETWEEN DOOR AND FRAME TO HOLD DOOR OPEN

(76) Inventor: Gregory Cress, Las Vegas, NV (US)

( * ) Notice: Subject to any disclaimer, the term of this patent is extended or adjusted under 35 U.S.C. 154(b) by 364 days.

(21) Appl. No.: 12/684,914

(22) Filed: Jan. 9, 2010

(65) Prior Publication Data

US 2010/0175324 A1 Jul. 15, 2010

Related U.S. Application Data

(60) Provisional application No. 61/143,479, filed on Jan. 9, 2009.

(51) Int. Cl.
*E05F 5/02* (2006.01)

(52) U.S. Cl.
USPC ..... 49/462; 49/460; 16/82; 16/86 A; 16/86 B; 16/374

(58) Field of Classification Search
USPC ..... 49/383, 460, 462; 16/82, 86 B, 374, 16/86 A
See application file for complete search history.

(56) References Cited

U.S. PATENT DOCUMENTS

| | | | | |
|---|---|---|---|---|
| 2,827,280 | A * | 7/1954 | Burkhalter | 267/140 |
| 4,878,267 | A * | 11/1989 | Roach et al. | 16/250 |
| 5,027,471 | A * | 7/1991 | Barnes | 16/86 R |
| D323,976 | S * | 2/1992 | Barnes | D8/402 |
| 5,511,837 | A * | 4/1996 | Dempsey et al. | 292/288 |
| 7,559,114 | B2 * | 7/2009 | Ranilovich | 16/82 |
| D603,694 | S * | 11/2009 | Bushey | D8/402 |
| 2003/0056318 | A1 * | 3/2003 | Renaud | 16/82 |
| 2006/0032017 | A1 * | 2/2006 | Agster et al. | 16/86 R |
| 2007/0261207 | A1 * | 11/2007 | Ranilovich | 16/374 |
| 2008/0079270 | A1 * | 4/2008 | Carlson | 292/343 |

* cited by examiner

*Primary Examiner* — Katherine Mitchell
*Assistant Examiner* — Marcus Menezes
(74) *Attorney, Agent, or Firm* — Michael Ries

(57) ABSTRACT

A doorprop for restricting the movement of a door within a doorway. The door includes a first door face surface and a first door side surface. The doorway includes a hinge jamb having a door edge abutting surface, a door side abutting surface, a jamb trim surface, and a hinge jamb edge. The stop includes a contoured body defined by an upper surface, a lower surface, a door face surface, a door contacting surface, a first door transition surface, a jamb face surface, a jamb trim edge surface, a jamb trim face surface, and a second transition surface. The door contacting surface is selectively in contact with the first door side surface.

9 Claims, 9 Drawing Sheets

DEVICE FOR INSERTION BETWEEN DOOR AND FRAME TO HOLD DOOR OPEN

CROSS REFERENCE TO RELATED APPLICATIONS

This application claims priority to U.S. Provisional Application 61/143,479, filed on, 9 Jan. 2009, the disclosure of which is hereby incorporated by reference in its entirety.

TECHNICAL FIELD

The disclosure relates generally to restraining items from moving, and specifically to devices that restrain a door.

BACKGROUND

Some doors are biased toward a closed position where the door will automatically close once a user no longer exerts an opening force on the door. When a user desires to restrain the door in an open position, the user may select a door prop that rests on the floor. However, ingress and egress through the doorway may result in inadvertently moving the door prop, resulting in undesirably permitting the door to close. If the door closes while a user or cargo is in the path of the door swing, the door, and/or cargo may be damaged. Examples of cargo that may be particularly sensitive to an inadvertent door impact include wedding cakes and glassware. Further, a user may be injured.

What is needed is a device to restrict movement of a door toward a closed position. A desirable device would allow workers to be more efficient by being able to quickly and effortlessly control the door. Other doors that do not have a mechanism to urge the door to a closed position may also be desired to have a device that will restrict door movement toward the closed position.

BRIEF DESCRIPTION OF THE DRAWINGS

The drawings are illustrative embodiments. The drawings are not necessarily to scale and certain features may be removed, exaggerated, moved, or partially sectioned for clearer illustration. The embodiments illustrated herein are not intended to limit or restrict the claims.

DETAILED DESCRIPTION

Figure 1:
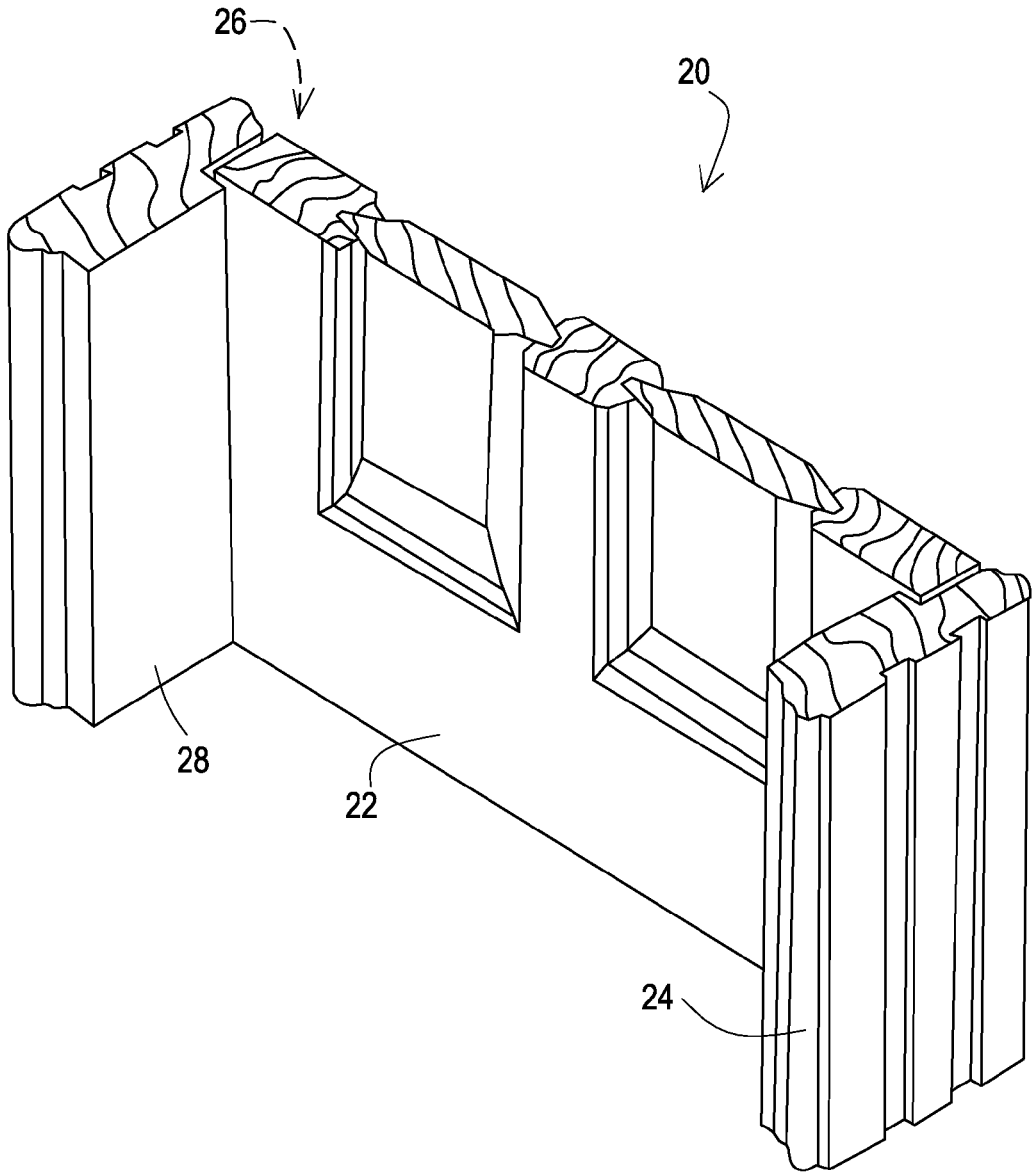
FIG. 1 is partially sectioned perspective view of a door, illustrated in a closed configuration.
Figure 2:
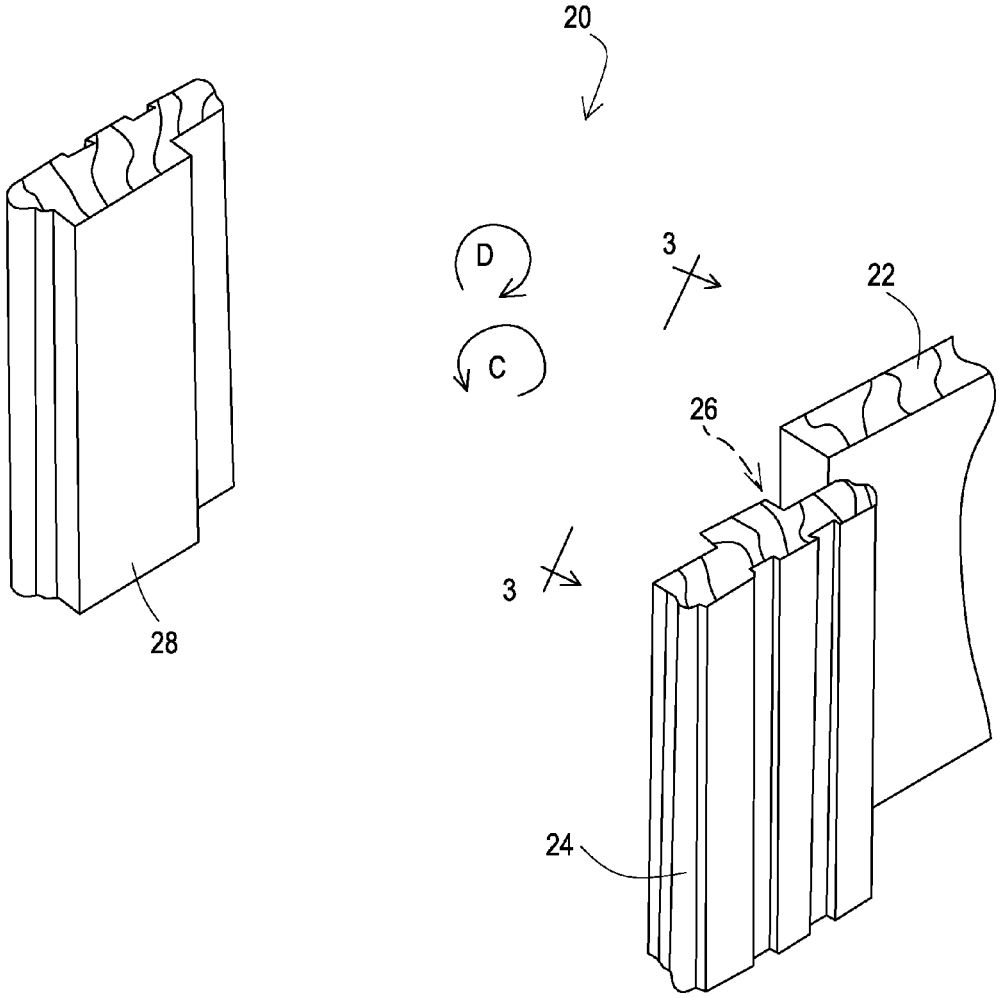
FIG. 2 is a partially sectioned perspective view of the door of FIG. 1 illustrated in one of a plurality of open configurations.
Figure 3:
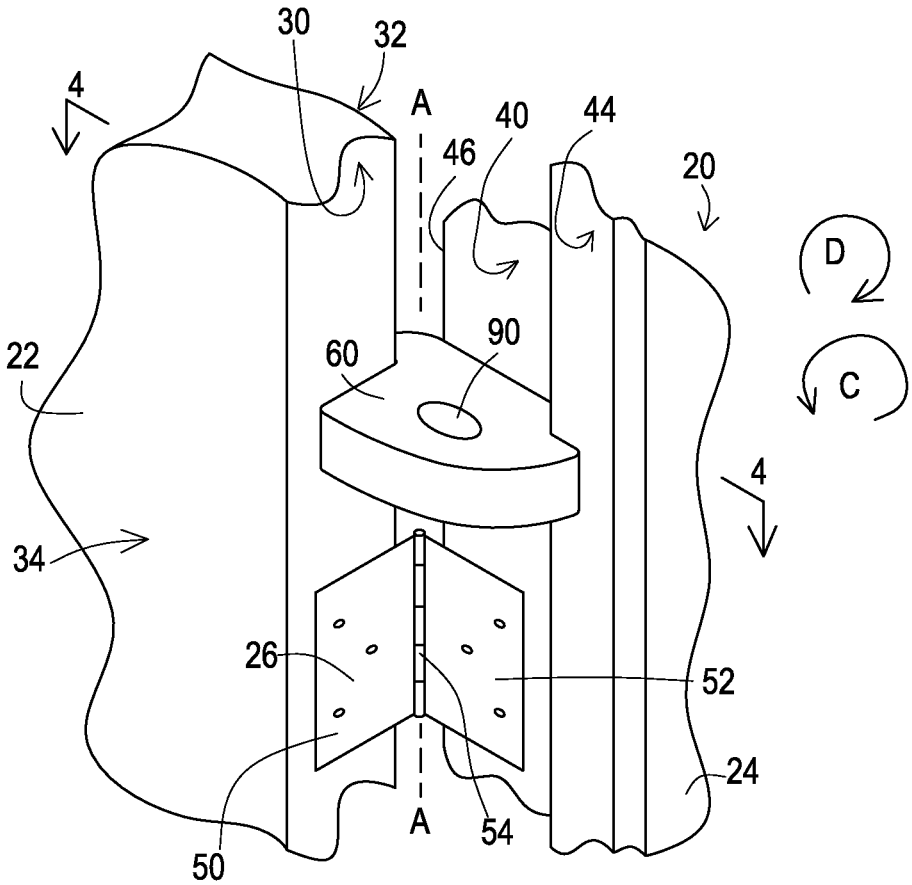
FIG. 3 is partially sectioned perspective view taken along line 3-3 of FIG. 2, with a doorprop according to an embodiment.

FIGS. 1-4 illustrate a portion of a door assembly 20. The assembly 20, as is known, includes a door 22, a hinge jamb 24, a plurality of hinges 26 (one illustrated in FIG. 3), and a latch jamb 28. As best seen in FIG. 3, the door 22, as is known, includes a generally planar first door side surface 30, a generally planar first door face 32, and a generally planar second door face 34. The hinge jamb 24 includes a door edge abutting surface 40, a door side abutting surface 42, a jamb trim surface 44, and a hinge jamb edge 46.

The hinge 26 includes a door member 50, a jamb member 52, and a shaft 54 generally defining an axis A-A. As is known, the door 22 rotates in a first rotational direction C and in a second rotational direction D relative the hinge jamb 24 generally about the axis A-A.

Figure 4:
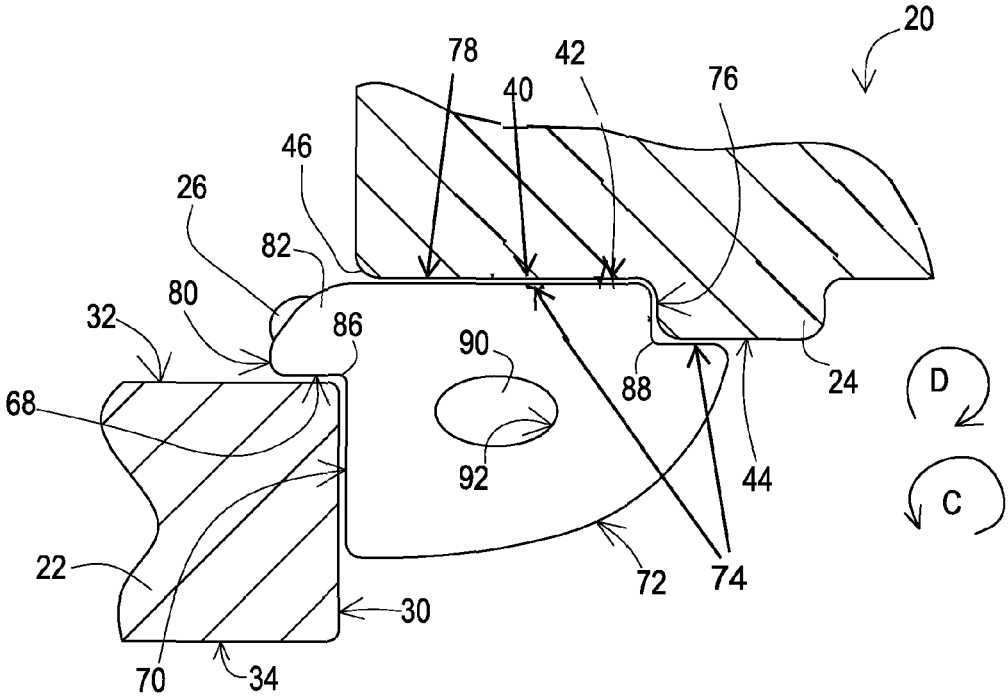
FIG. 4 is a sectional view taken along line 4-4 of FIG. 3.
Figure 5:
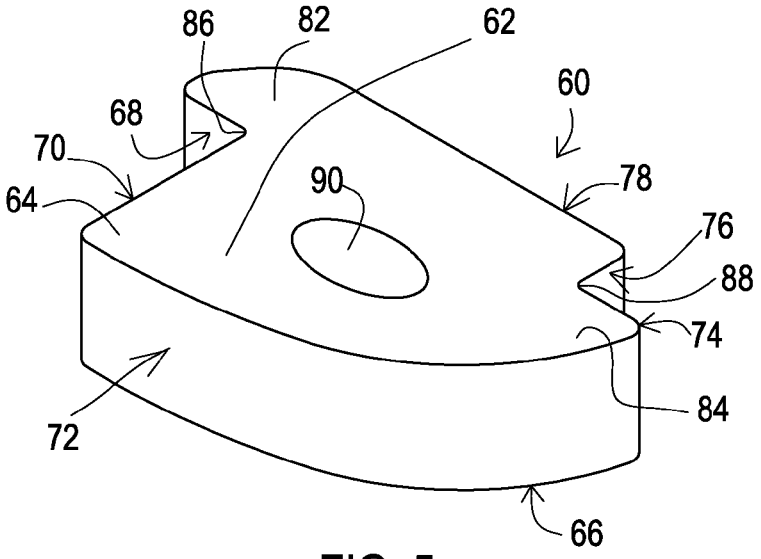
FIG. 5 is a perspective view of the doorprop of FIG. 3.
Figure 6:
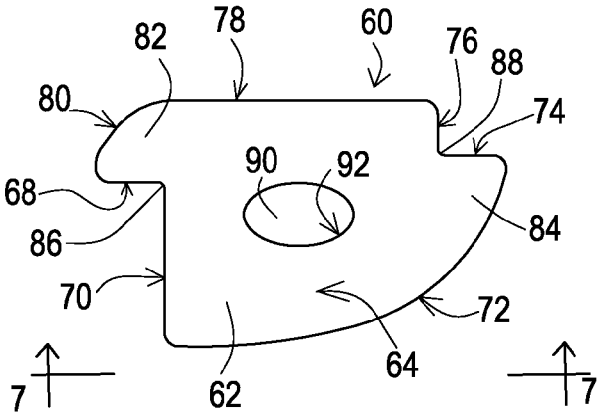
FIG. 6 is a top view of the doorprop of FIG. 3.
Figure 7:
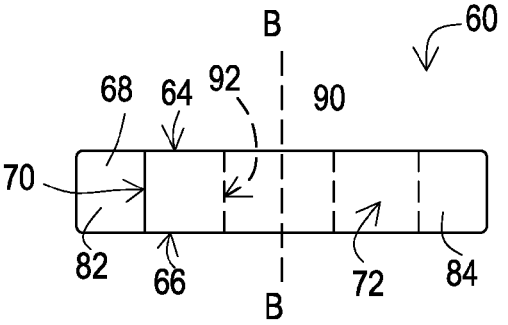
FIG. 7 is a side view of the doorprop of FIG. 3, taken generally along the line 7-7 of FIG. 6.

As best seen in FIGS. 3 and 4, a doorprop 60 may be interposed between the door 22 and the hinge jamb 24. As best seen in FIGS. 5-7, the doorprop 60 is defined by a contoured body 62 defined by an upper surface 64, a lower surface 66, a door face surface 68, a door contacting surface 70, a first door transition surface 72, a jamb face surface 74, a jamb trim edge surface 76, a jamb trim face surface 78, and a second transition surface 80.

In the embodiment illustrated, the doorprop 60 also includes a first extending portion 82 a second extending portion 84, a door inner edge 86, and a jamb inner edge 88. In the embodiment illustrated, the doorprop 60 further includes an aperture 90 formed therein generally defined by an inside surface 92 and an axis B-B (FIG. 7). The aperture 90 may be oval, elliptical circular, or any desired shape.

In an embodiment, the door face surface 68 is generally parallel to the jamb trim face surface 78, and the door contacting surface 70 is generally parallel to the jamb trim edge surface 76. In the embodiment illustrated, the first door transition surface 72 is curved to reduce the occurrences of an item inadvertently contacting the doorprop 60 as a user goes through the doorway.

As best seen in FIG. 4, the door contacting surface 70 is selectively in contact with a portion of the first door side surface 30; the first door face 32 is selectively in contact with the door face surface 68; the door edge abutting surface 40 is selectively in contact with the jamb trim face surface 78; the door side abutting surface 42 is selectively in contact with the jamb trim edge surface 76; and the jamb trim surface 44 is selectively in contact with the jamb face surface 74.

When the door 22 is urged in the first rotational direction C, the first door side surface 30 is moved toward the door edge abutting surface 40. As the door 22 is urged in the first rotational direction C, a portion of the body 62 is compressed between the first door side surface 30 and the door edge abutting surface 40. In the embodiment illustrated, the body 62 of the doorprop 60 will deform such that the door contacting surface 70 will move toward the jamb trim face surface 78.

When the door 22 is urged in the second rotational direction D, the first door side surface 30 is moved away from the door edge abutting surface 40. As the door 22 is urged in the second rotational direction D, the first extending portion 82 of the body 62 may be compressed between the first door face 32 and the hinge jamb edge 46.

In one embodiment, the doorprop 60 is injection molded of a recycled vulcanized rubber, although other materials may be used as desired. The doorprop 60 may be illustrated in FIG. 4 as slightly smaller than actual. That is, the doorprop 60 may be proportioned so as to interfere with the door 22 and the hinge jamb 24, where FIG. 4 illustrates slight gaps therebetween for clarity of illustration.

In another embodiment, the doorprop 60 is constructed of a recycled vulcanized rubber and the door 22 is biased to move in the first direction C by a spring or other mechanism. This biasing of the door 22 will compress the body 62, thereby retaining the doorprop 60 in position.

FIGS. 8-12 illustrate an embodiment of a device is illustrated as a doorprop 120. The doorprop 120 is defined by a contoured body 122 defined by an upper surface 124, a lower surface 126, a door face surface 128, a door contacting surface 130, a first door transition surface 132, a jamb face surface 134, a jamb trim edge surface 136, a jamb trim face surface 138, and a second transition surface 140.

Figure 12:
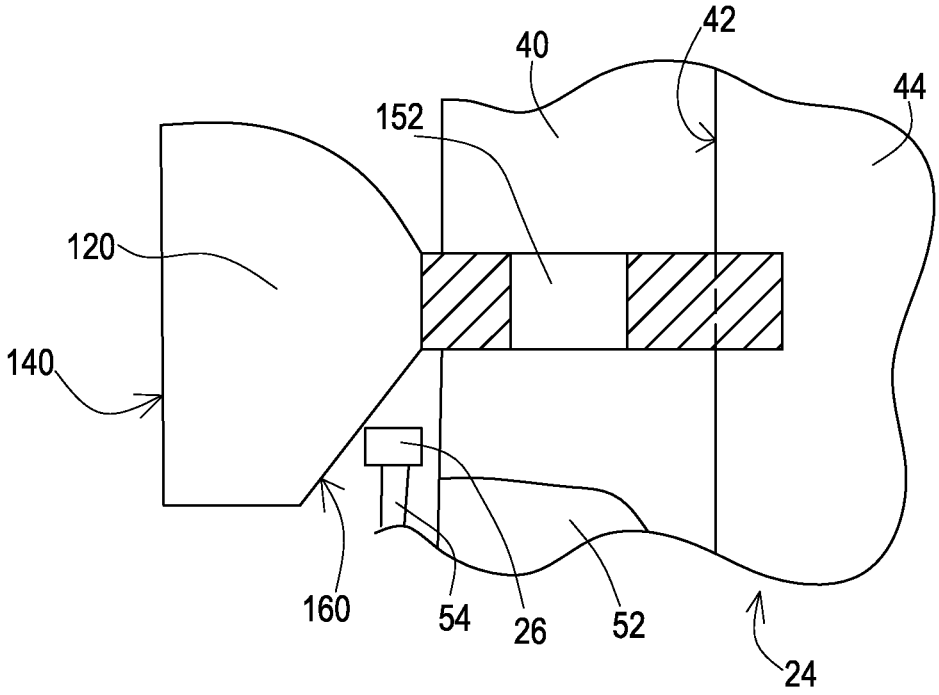
FIG. 12 is a view taken generally along line 12-12 of FIG. 9.

In the embodiment illustrated, the doorprop 120 also includes a first extending portion 142 a second extending portion 144, a door inner edge 146, and a jamb inner edge 148. In the embodiment illustrated, the doorprop 120 further includes an aperture 150 formed therein generally defined by an inside surface 152 and an axis E-E. The aperture 150 may be oval, elliptical circular, or any desired shape. As best seen in FIG. 12, the doorprop 120 first extending portion 142 includes a lower angled surface 160.

Figure 9:
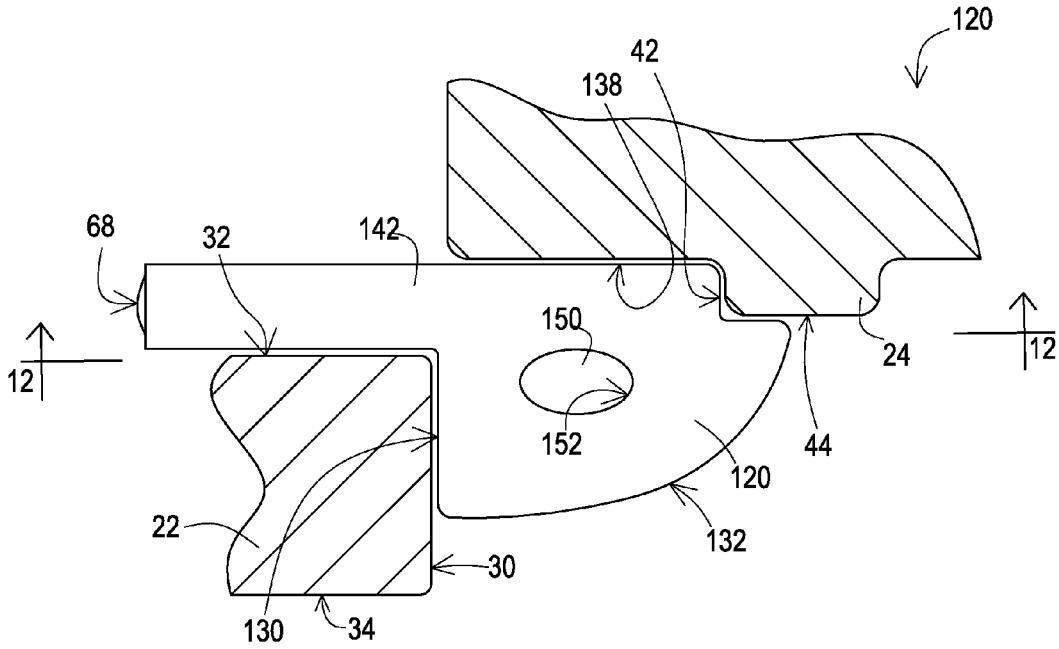
FIG. 9 is a top view of the doorprop of FIG. 8.
Figure 10:
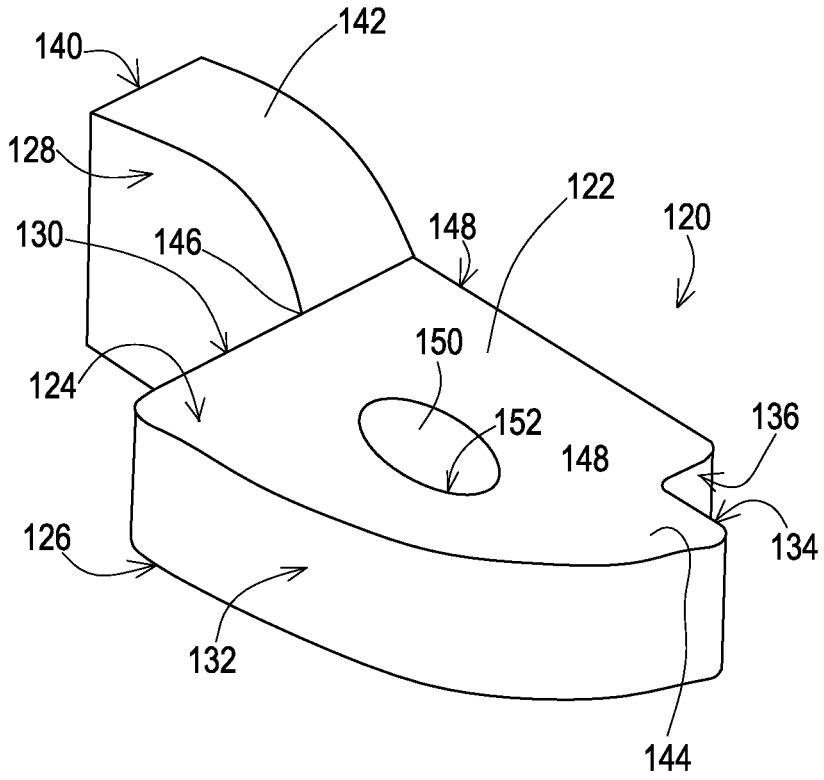
FIG. 10 is an enlarged perspective view of the doorprop of FIG. 8.
Figure 11:
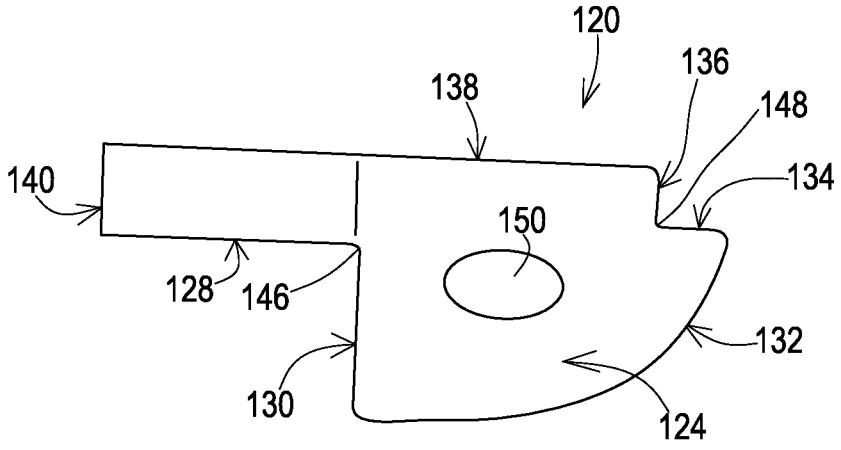
FIG. 11 is a top view of the doorprop of FIG. 8.

As best seen in FIG. 9, the door contacting surface 130 is selectively in contact with a portion of the first door side surface 30; the first door face 32 is selectively in contact with the door face surface 128; the door edge abutting surface 40 is selectively in contact with the jamb trim face surface 138; the door side abutting surface 42 is selectively in contact with the jamb trim edge surface 136; and the jamb trim surface 44 is selectively in contact with the jamb face surface 134.

As best seen in FIGS. 9 and 12, when the doorprop 120 is thus positioned, the lower angled surface 160 will contact the upper surface of the shaft 54 of the hinge 26. The weight of the first extending portion 142 will urge the lower angled surface 160 to guide along the upper surface of the shaft 54 and therefore urge the door contacting surface 130 toward the first door side surface 30 and in binding contact therewith. This urging force may retain the doorprop 120 to remain in the position illustrated in FIG. 12 as the hinge 26 is used as a fulcrum for the doorprop 120.

When the door 22 is urged in the first rotational direction C, the first door side surface 30 is moved toward the door edge abutting surface 40. As the door 22 is urged in the first rotational direction C, a portion of the body 122 is compressed between the first door side surface 30 and the door edge abutting surface 40. In the embodiment illustrated, the body 122 of the doorprop 120 will deform such that the door contacting surface 130 will move toward the jamb trim face surface 138.

When the door 22 is urged in the second rotational direction D, the first door side surface 30 is moved away from the door edge abutting surface 40. As the door 22 is urged in the second rotational direction D, the first extending portion 142 of the body 122 may be compressed between the first door face 32 and the hinge jamb edge 46.

Figure 8:
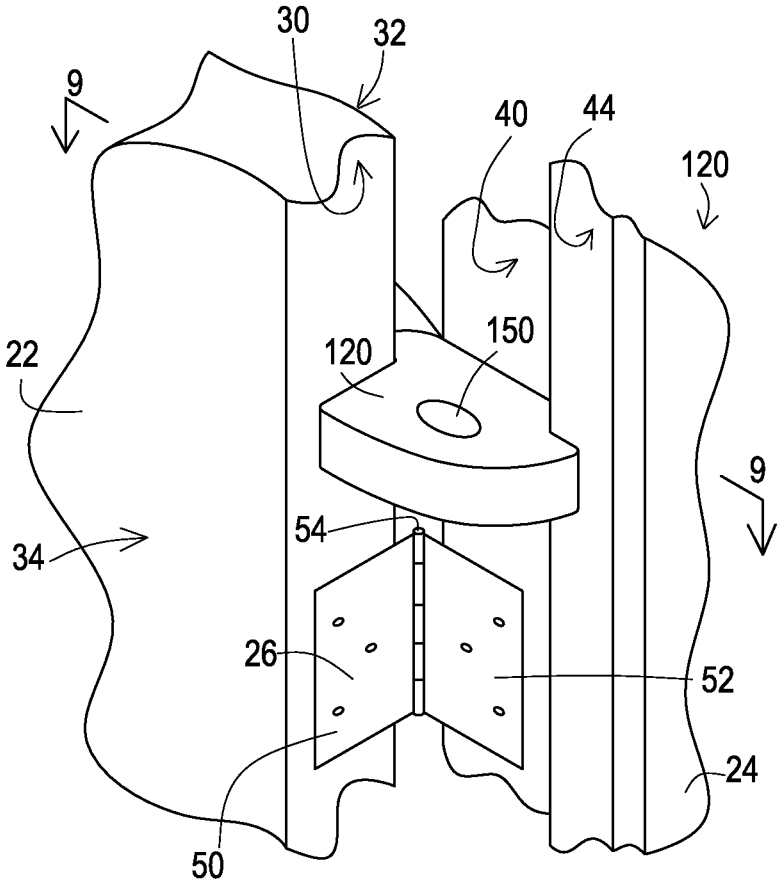
FIG. 8 is partially sectioned perspective view taken along line 3-3 of FIG. 2, with a doorprop according to another embodiment.

FIG. 8 illustrates a partially exploded view for clarity where the doorprop 120 is spaced away from the hinge 26. In one embodiment of operation, the doorprop 120 is partially supported by the hinge 26 where the weight of the first extending portion 142 may be about the same or more as the weight of the remainder of the doorprop 120 such that the doorprop 120 will remain in position atop the hinge 26, thereby retaining the doorprop 120 for a door 22 that is not biased in the first rotational direction C.

To install the doorprop 120, a user may interpose the first extending portion 142 between the door 22 and the hinge jamb 24 and then lower the doorprop 120 until the doorprop 120 contacts a hinge 26.

The apertures may permit the doorprop to compress such that damage to the door assembly is avoided. Further, the apertures, friction between the doorprop and the door assembly, and resilient construction of the doorprops permit the contacting surfaces between the doorprop and the doorway to remain in contact when the door is moved, thereby preventing the doorprop from falling from position. Further, dimensions of the doorprop, such as the thickness (distance between the upper surface and lower surface) and the dimensions of the aperture may be varied, as desired, to accommodate differing door assemblies. Still further, the rigidity of the doorprop may be varied as desired.

While in the embodiments illustrated above the apertures have ambient air therein, the apertures 90, 150 may have a resilient member interposed therein. In an embodiment, the resilient member completely fills the aperture. Further, the resilient member may be formed of a material that is more resistant to compression that the material of the doorprop, or may be formed of a material that is less resistant to compression that the material of the doorprop. When a resilient material such as rubber is used for the doorprops, the apertures may be filled with air or any material that is less dense than the rubber.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A door prop to restrict the movement of a door within a doorway, wherein the door includes a door back surface and a door side surface, and wherein the doorway includes a hinge jamb having a door edge abutting surface, a door side abutting surface, a jamb trim surface, and a hinge jamb edge, comprising:

a contoured body defined by an upper surface, a lower surface, a door face surface, a door contacting surface, a first door transition surface, a jamb face surface, a jamb trim edge surface, a jamb trim face surface, and a second door transition surface; wherein the door contacting surface is in contact with the door side surface, the door back surface is in contact with the door face surface of the contoured body, the door edge abutting surface is in contact with the jamb trim face surface, the door side abutting surface is in contact with the jamb trim edge surface, and wherein the jamb trim surface is in contact with the jamb face surface, the door face surface is generally parallel to the jamb trim face surface and the door contacting surface is generally parallel to the jamb trim edge surface;

a centered aperture to permit the door prop to compress to avoid damage to the door and friction between the door prop and the door to permit a plurality of contacting surfaces between the door prop and the door to remain in contact when the door is moved, thereby preventing the door prop from falling from position; and an extending portion of the body extending from the door face surface and the jamb trim face surface is compressed by the door back surface and the hinge jamb edge when the door is urged in a rotational direction such that the door side surface is moved away from the door edge abutting surface, the extending portion is in contact with a hinge that interconnects the hinge jamb and the door to retain the door prop in position.

2. The door prop of claim 1, wherein the body is formed of a vulcanized rubber.

3. A method of restricting the movement of a door within a doorway, wherein the door includes a door back surface and a door side surface, and wherein the doorway includes a hinge jamb having a door edge abutting surface, a door side abutting surface, a jamb trim surface, and a hinge jamb edge, the method comprising:

providing the doorprop according to claim 1, said doorprop defining an upper surface, a lower surface generally opposing the upper surface, a door face surface, a door contacting surface, a first door transition surface, a jamb face surface, a jamb trim edge surface, a jamb trim face surface, and a second door transition surface;

forming an aperture within the doorprop; and positioning the doorprop adjacent the door such that the door contacting surface is in contact with the door side surface, the door back surface is in contact with the door face surface, the door edge abutting surface is in contact with the jamb trim face surface, the door side abutting surface is in contact with the jamb trim edge surface, and wherein the jamb trim surface is in contact with the jamb face surface.

4. The method of claim 3, further comprising interposing a resilient member within the aperture.

5. The method of claim 3, further comprising biasing the door back surface toward the door edge abutting surface with a biasing mechanism.

6. The method of claim 3, further comprising forming a extending portion extending from the doorprop and along the door back surface, wherein the extending portion is about the same weight as the remainder of the doorprop.

7. The method of claim 3, further comprising interposing the first extending portion between the door and the hinge jamb.

8. The method of claim 7, further comprising lowering the doorprop until a portion of the doorprop contacts a hinge that interconnects the door and the hinge jamb.

9. The method of claim 8, further comprising permitting a surface portion of the extending portion to guide along a surface portion of the hinge for urging the doorprop toward the door.

* * * * *